US006874220B1

(12) United States Patent
Jones

(10) Patent No.: US 6,874,220 B1
(45) Date of Patent: Apr. 5, 2005

(54) METHOD AND APPARATUS FOR MOUNTING AN ACOUSTIC TRANSDUCER

(75) Inventor: Barbara L. Jones, King's Lynn (GB)

(73) Assignee: Snap-on Equipment Limited, King's Lynn (GB)

( * ) Notice: Subject to any disclaimer, the term of this patent is extended or adjusted under 35 U.S.C. 154(b) by 369 days.

(21) Appl. No.: 10/030,542

(22) PCT Filed: Sep. 5, 2000

(86) PCT No.: PCT/GB00/03398

§371 (c)(1),
(2), (4) Date: Jan. 10, 2002

(87) PCT Pub. No.: WO01/19131

PCT Pub. Date: Mar. 15, 2001

(30) Foreign Application Priority Data

Sep. 8, 1999 (GB) ..... 9921142

(51) Int. Cl.[7] ..... H04R 31/00

(52) U.S. Cl. ..... 29/594; 29/592.1; 29/602.1; 381/396; 381/398; 181/171; 181/172

(58) Field of Search ..... 29/592.1, 594.1, 29/609.1; 381/396, 398; 181/171, 172; 248/74.3, 248/231.5; 384/172, 276, 295–300

(56) References Cited

U.S. PATENT DOCUMENTS 4,811,250 A 3/1989 Steber et al.
4,981,194 A * 1/1991 Kamon et al. ..... 181/129
5,013,166 A 5/1991 Domer ..... 384/220
5,305,978 A * 4/1994 Current ..... 248/230.4
5,850,461 A * 12/1998 Zelinka ..... 381/398

FOREIGN PATENT DOCUMENTS

| | | | |
|---|---|---|---|
| DE | 2433824 A | * | 1/1976 |
| GB | 845891 | | 8/1960 |
| GB | 1169688 | | 11/1969 |
| GB | 1178927 | | 1/1970 |
| GB | 1289746 | | 9/1972 |
| GB | 1498891 | | 1/1978 |
| GB | 2046401 | | 11/1980 |
| WO | WO 93/04381 | | 3/1993 |
| WO | WO 98/12453 | | 3/1998 |

OTHER PUBLICATIONS

"Ultrasonic visualization method of electrical trees formed in organic insulating materials"; Watanabe, E.; Moriya, T.; Yoshizawa M.; Dielectrics and Electrical Insulation; Oct. 5, 1998; pp.:767-773.*

* cited by examiner

*Primary Examiner*—Paul D Kim
(74) *Attorney, Agent, or Firm*—Seyfarth Shaw LLP

(57) ABSTRACT

A method and apparatus for mounting an acoustic emitter or detector of other sensor apparatus with respect to mounting structure therefor and so as to be isolated at least partially with respect thereto from the transmission of acoustic and/or electrical energy. The mounting provides a non-elastomeric snap-together bushing formed of a plastics material which accurately positionally locates the sensor or emitter with respect to its mounting while providing an unexpectedly high degree of isolation with respect to transmission of acoustic and other energy forms through the mounting.

10 Claims, 6 Drawing Sheets

METHOD AND APPARATUS FOR MOUNTING AN ACOUSTIC TRANSDUCER

BACKGROUND

This application relates to position-defining and energy-isolating mountings. In particular it relates to mountings used to mount transducers such as acoustic emitters and/or detectors within a system used for three-dimensional coordinate determination adapted, in particular, for automotive crash repair and diagnostics.

An example of the application of the position-defining and energy-isolating mountings is in vehicle shape-determination systems of the kind disclosed in WO 93/04381, in which the present position-defining and energy-isolating mountings provides a mounting of the kind required for the array of microphones (18) which are mounted with respect to a beam (10) for use in the manner briefly disclosed and illustrated in data items (54) and (57) on the front page of the above-identified WO publication.

A similar such vehicle shape determination system is also described in European Patent EP 0,244,513 (and corresponding US patent U.S. Pat. No. 4,811,250). In EP 0 224 513 B1 (Applied Power Inc/Steber) a system for acoustic-based three-dimensional coordinate analysis as applied to automotive vehicles is described. In this system acoustic signals from transmitter means at a series of defined locations are received by acoustic receiver means. The receiver/transmitter means are located at a series temporarily fixed separated locations throughout a series of measurements, and signals received are sent to data processing means whereby a time-based determination of the coordinates of each of the reference locations is made by a calculation technique utilising the acoustic signal transmission time differential for two transmitters at each location of known spacing from each other at that location, and by reference to a simple triangulation technique. There are also numerous other published specifications and examples of such systems in which arrays of emitters/sensors, are mounted on a fixed frame and interact with cooperating sensors/emitters which are positioned at reference positions relative to the shape to be determined, with data processing means interpreting the signals sensed by the sensors in order to determine the relative positional information.

In the case of existing mountings for the emitters and/or detectors the kind used in the above techniques with which the present position-defining and energy-isolating mountings is concerned, such as miniature microphones, the current assumption is that in such mountings a degree of vibration damping should be provided and that the microphones should be vibration isolated from the beam of frame within which they are placed. In addition the miniature microphones require accurate placement, ease of mounting, ease of dismounting or replacement, and a degree of physical shielding from impact or similar damage. These requirements should all be provided and met by the mounting. Accordingly the currently available solution to this interplay of (to some extent) conflicting physical requirements on the mounting has been to use a mounting of a two-piece construction in which an elastomeric bushing envelops the microphone itself and serves to provide vibration isolation of the microphone and damage protection. Then, in order to meet the requirement for relatively accurate position definition for the microphone there is additionally provided a metallic collar around the elastomeric bushing. The collar serves to engage the beam on which the array of microphones are mounted and thus serves to position relatively accurately the collar itself with respect to the beam and through the interaction (via adherence) of the collar with the elastomeric bushing, the collar exerts a degree of position control on the microphone itself.

With such a mounting insertion of the microphone into the bushing and collar assembly is achieved by means of an end-insertion technique in which a projecting length of microphone conductor (and associated electrical shielding) is inserted through the bushing and through its associated end cable holder, and is then caused to fit snugly into the main body of the bushing. There is a further means for achieving this by tensioning the conductor. In other words, the microphone is pulled into its bushing by its lead. This can readily cause damage to the electrical connection to the microphone.

Other shortcomings of the previously-used microphone mounting system include the lack of accuracy of positional and/or orientational placement of the microphone due to the inherent ineffective transmission of position information through the elastomeric bushing from the mounting collar.

Additionally, the mounting process is relatively difficult due to frictional effects arising during the endwise insertion process, particularly if the assembly person is conscious of the need not to damage the electrical connections to the microphone.

There is also a need for a provision of means, in the case of mountings of the general kind disclosed herein, for accommodating a degree of non-circularity (such as ovality) in the mounting openings provided in the support for the acoustic emitter or detector or other sensor, without prejudicing the accuracy of mounting. In general terms, the matching of a circular fitting to a circular receptor is not readily achievable in practical circumstances in relation to field-used articles of this kind without difficulties and/or costs and some improvements in this respect are needed.

It is noted that vibration damping and isolating mounting arrangements are used in other fields and to mount other components. Such arrangements are described in, the following published patent specifications: WO 98/12453, GB 2046,401, GB 1,498,891; GB 1,289,746; GB 845,891; U.S. Pat. No. 5,013,166; and GB 1,169,688. These prior arrangements all use an elastomeric material, predominantly rubber, within the mounting in order to sufficiently isolate the mounted component from the structure to which it is attached. In a further prior patent GB 1,178,927 the mounting provides the required degree of resilience, as would be expected from an elastomeric material, by using sufficiently thin resilient arms members/straps to support the mounted component.

While such arrangements are similar to the above described current mounting of the microphones, in that they provide vibration isolation using elastomeric materials (or mimic the resilience of such materials), it should be recognized that the requirements for mounting a sensitive electronic component like a microphone are very different. Also the specific requirements of the mounting dictated by above system within which the microphone forms a key part, are very different from the components and arrangements with which these prior mounting patents are concerned. The prior patents relating to mounting structural floor panels, torsion bars and pipes etc.

SUMMARY

An object of the present position-defining and energy-isolating mountings is to provide a mounting method and apparatus, particularly applicable to the mounting of acoustic sensors and emitters, but which may have novelty and/or inventive step in relation to features which are wide enough to embrace mountings usable outside the field of acoustic emitters and sensors, as identified above, and providing improvements in relation to one or more of the factors identified above and/or improvements generally therein.

According to the position-defining and energy-isolating mountings there is provided a method and apparatus for mounting an acoustic emitter or detector, or other sensor, as defined in the accompanying claims.

In embodiments described below there is provided a method and apparatus wherein a mounting for a sensor such as an acoustic emitter or detector, provides location definition and acoustic energy isolation by means of a single unitary structure comprising a non-elastomeric polymeric plastics material.

It has unexpectedly been found that such a mounting provides sufficient isolation of the sensor, in particular microphone, within the system with which the position-defining and energy-isolating mountings is concerned, for the system to operate satisfactorily. This represents one important aspect of the present position-defining and energy-isolating mountings and is based upon the apparent unexpected discovery that, in the systems with which the position-defining and energy-isolating mountings is concerned, the microphone or sensor does not have to be mounted so that it is vibration isolated from the beam or frame structure to which it is mounted. This is completely contrary to the understanding of the requirements and practice hitherto.

Alternatively and/or in addition it is based upon the unexpected related further discovery that a relatively high (or at least sufficient for the requirements of the systems with which the position-defining and energy-isolating mountings is concerned) degree of energy isolation as required so that the sensors (microphones) are substantially unaffected and operate correctly, can be achieved without the need to employ elastomeric materials (as are currently used in such mountings). The non-elastomeric plastics material reducing the level of energy transmission to acceptable limits, both in relation to acoustic or certain other energy forms present.

More specifically, in the embodiments we found that non-elastomeric polymers such as polypropylene provide at the acoustic frequencies discussed below a required level of acoustic isolation, while not possessing the positional shortcomings of elastomeric polymers.

For the avoidance of doubt, it needs to be said that substantially all solid materials have a degree of resilient deflectability which is measurable and well known. For the purposes of the present position-defining and energy-isolating mountings this fact is not relevant since the elastomeric polymers with which the embodiments of the present position-defining and energy-isolating mountings are contrasted are those such as natural and synthetic rubbers for which the level of resilient deflectability is on a substantially different scale.

In the embodiments of the present position-defining and energy-isolating mountings, the adoption of a non-elastomeric plastics polymer to provide the unexpectedly high level of acoustic energy isolation (and indeed isolation with respect to other relevant energy forms as discussed above) leads to the resultant advantage that the polymer itself simultaneously provides that level of accurate position-definition which the microphone placement and mounting within the above-identified shape determining systems requires. A non-elastomeric material providing a more accurate mounting as compared generally to one in which an elastomeric material is used. The combination of energy isolation and position definition represents a significant step forward with respect to the previously accepted requirement for a two-piece structure with its attendant penalties in terms of cost and ease of assembly.

Also, in the embodiments disclosed below there is provided bushing means for the microphone or other sensor or emitter which provides a snap-fit or clip-fit structure which serves to engage and grip the sensor or emitter on opposite sides thereof, and likewise engages or grips the associated cable or the like, thereby mechanically interconnecting the two and serving to provide a strengthened link between these parts of the apparatus whereby the previous damage-causing tugging on the lead or connector no longer causes harm. To a certain extent the beneficial use of such and arrangement is due, at least in part, to the ability to use a different type of mounting using a plastics material in a unitary structure rather than needing to use an elastomeric material within the mounting.

In the embodiments a mounting for an acoustic emitter or detector which removably mounts such with respect to a support comprises a non-elastomeric polymeric plastic bushing which is adapted to be a press fit into a complimentary mounting opening in a support therefor, and the bushing provides contact at a plurality of at least three spaced locations around the opening, whereby the bushing can accommodate a degree of ovality of the mounting opening, while nevertheless accurately defining the mounted position of the emitter or detector with respect to the support. In the embodiments the contact regions of the bushing are arcuate in form and in fact four are provided in the illustrated embodiments.

By providing a snap-fit or clip-fit mounting which engages and grips the emitter or sensor and its lead there is not only provided the mechanical advantage identified above but also a significant simplification of the assembly and disassembly method since the snap-fit or clip-fit assembly technique is reversible and disassembly is just as easily achieved. The need for endwise insertion and the accompanying delays and potential damage causation is also eliminated by the side-wise (as opposed to end-wise) assembly technique provided by the use of this a mounting.

Also in the embodiments, the snap-fit bushing is provided as a one-piece assembly in which two halves are interconnected by hinge-means permitting ready (and accurate) cooperation for snap or clip fitting and unfitting as needed. In addition, there may be provided on the mounting a visible orientation mark so that the bushing or collet when installed on its beam or other structure is at a predetermined orientation with respect to it.

In the embodiments, in addition to polypropylene other non-elastomeric polymeric materials may be employed such as nylon derivatives, acetyl and ABS and other non-elastomers.

The present position-defining and energy-isolating mountings is not limited in its application to the specific utility described hereto and provides significant advantages in relation to the mounting acoustic emitter and/or detectors in other similar systems and generally.

Furthermore the mounting can also be used with like emitters or sensors of various kinds used in systems of the type described in the embodiment discussed herein and more generally. Other such kinds of sensors or emitters include thermal and electrical and optical sensors, particularly for electronic measuring equipment, in which a facility for ease of mounting and/or dismounting and accompanied by a satisfactory level of position-definition when mounted, in combination with isolation (to the degree necessary for the particular practical application) from the transmission to or from the mounted sensor or emitter of acoustic or electrical or other energy.

In the case of the specific embodiment disclosed below, the mounting provides location definition and ease of mounting and dismounting together with a satisfactory level of isolation with respect to acoustic energy.

BRIEF DESCRIPTION OF THE DRAWINGS

Embodiments of the position-defining and energy-isolating mountings will now be described by way of example with reference to the accompanying drawings in which.

DETAILED DESCRIPTION OF PRESENTLY PREFERRED EMBODIMENTS

A system for three-dimensional coordinate determination adapted, in particular, for automotive crash repair and diagnostics, within which the present position-defining and energy-isolating mountings may be applied; is described in EP 0 244 513 B1. Accordingly we hereby incorporate in the present application the entire disclosure of the EP 0 244 513 B1 by reference. A similar system is also described in WO 93/04381 and we similarly hereby incorporate in the present application the entire disclosure of the W093/04381 specification by reference.

Figure 1:
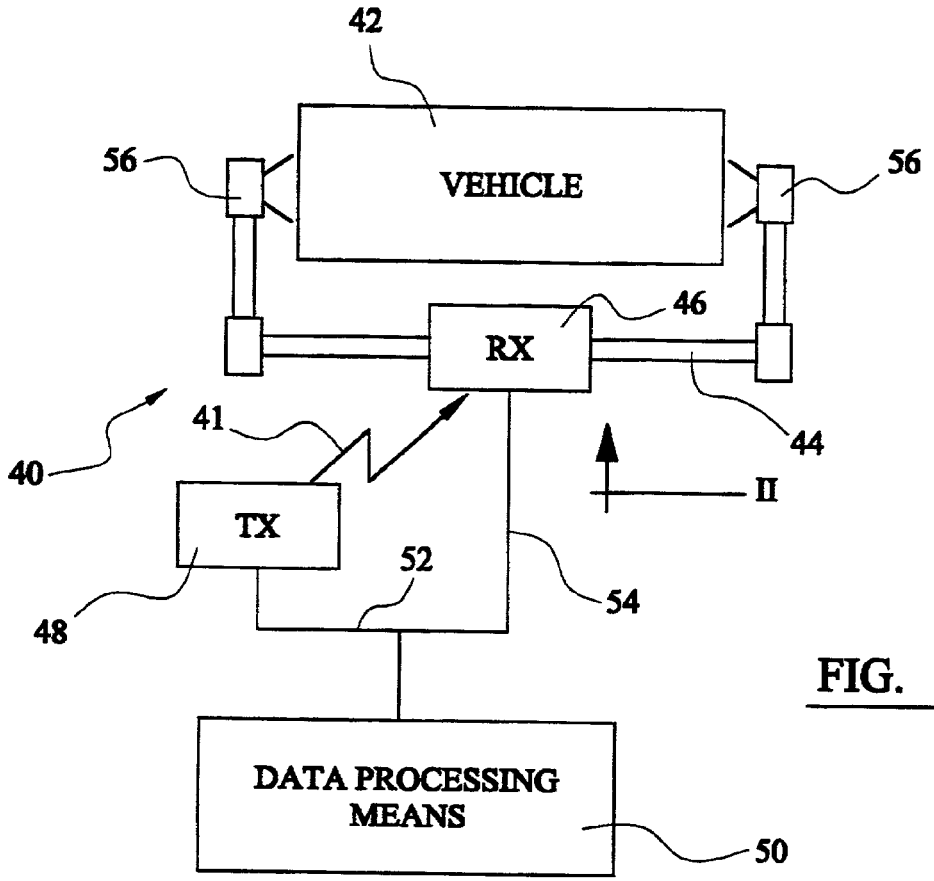
FIG. 1 is a schematic illustration of a three dimensional co-ordinate determination system for automotive crash repair and diagnostics with which the position-defining and energy-isolating mountings are used.
Figure 1A:
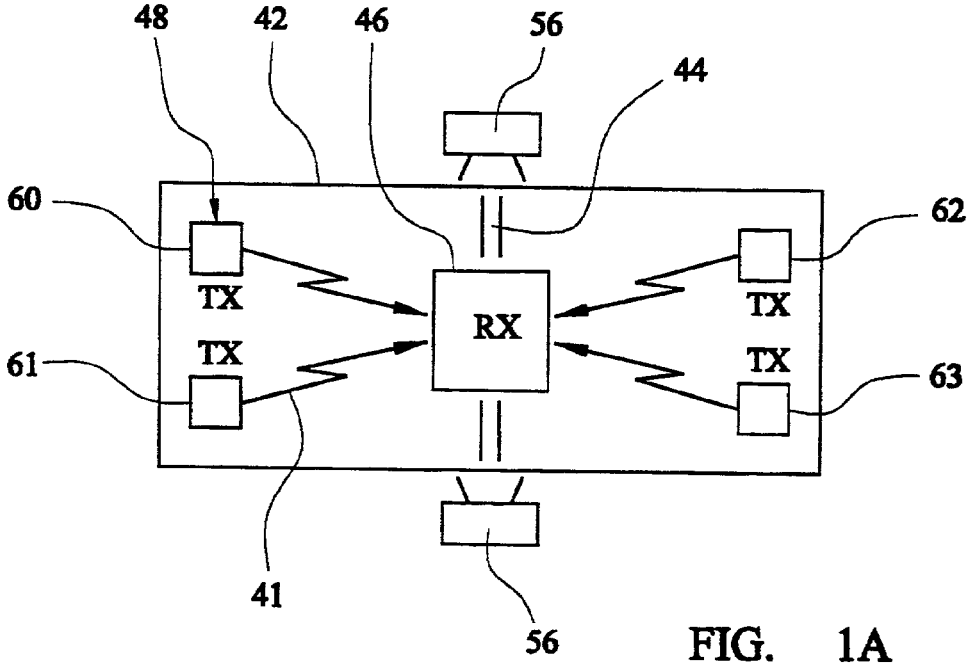
FIG. 1*a* is a schematic illustrative view on arrow II of the schematic illustration of FIG. 1.

Apparatus 40 for three-dimensional coordinate determination adapted for automotive crash repair and diagnostics is shown in FIGS. 1 and 1*a*. The apparatus 40 comprises transmitter means 48, receiver means 46 and data processing means 50 adapted to process data derived from the transmission of an energy signal 41 between the transmitter and receiver means 48, 46 to determine information with respect to the three-dimensional coordinates of one of the transmitter means and the receiver means 48, 46 (in this case the transmitter means 48), with respect to the other thereof (in this case the receiver means 46).

In use, the apparatus 40 is used to carry out a series of coordinate data evaluation steps in which one of the transmitter and receiver means 46, 48 (in this case the transmitter means 48) is applied to a series of identifiable locations 60, 61, 62, 63, 64 (see FIG. 1A). In FIG. 1A only four such locations have been shown, but in practice many more such locations are employed, as disclosed for example in the above-mentioned EP 513 B1 specification. Energy signals 41 are transmitted from transmitter means 48 to receiver means 46 while data evaluation steps are carried out. Usually, the steps of transmission and receiving and data evaluation are carried out from the locations 60 to 64 in sequence. It is an important requirement of the process that the receiver means 46 is maintained at a constant position with respect to automotive vehicle 42 throughout these steps.

As also shown in FIGS. 1 and 1A, the apparatus 40 further comprises a frame or the like structure 44. In FIG. 1, the frame or the like structure 44 extends below the body of vehicle 30, but above ground level, not shown in FIG. 1 on which the vehicle is supported by its ground wheels (also not shown). The frame or the like structure 44 provides a fixed and stable mounting structure on which the receiver means 46 (acoustic microphone or camera) are mounted so as to be able to communicate with transmitter means 48 via energy signals 41, as indicated in FIG. 1A. The frame or the like structure 44 comprises a transverse frame member. The frame may be fixed to the vehicle 42 via attachment means features 56 (for example arms and suction cups) in order to locate the frame 44 relative to the vehicle 42 during the measurements.

Figure 2:
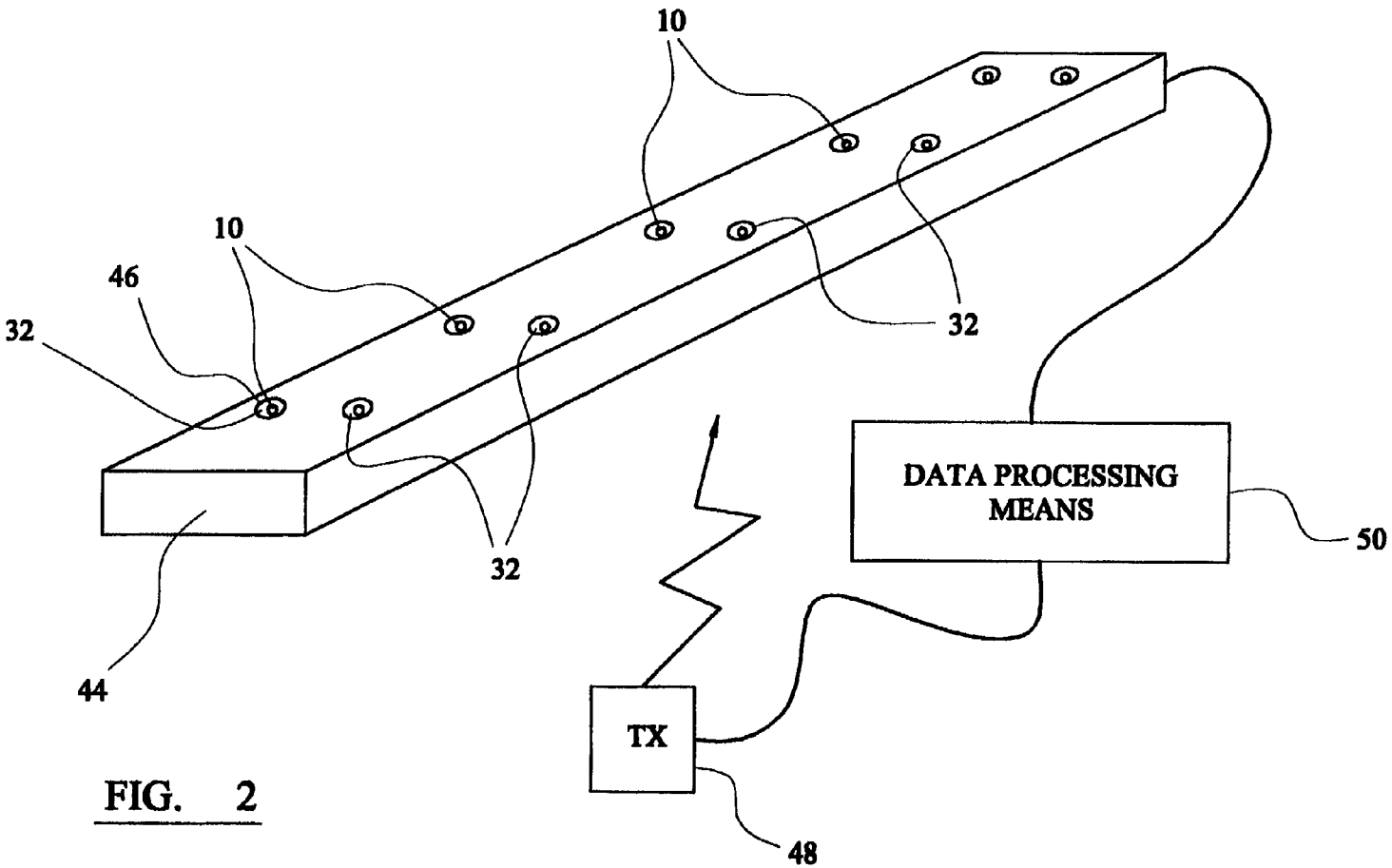
FIG. 2 is a more detailed perspective view of the beam or frame upon which the acoustic detectors of the system of FIG. 1 are disposed.
Figure 3:
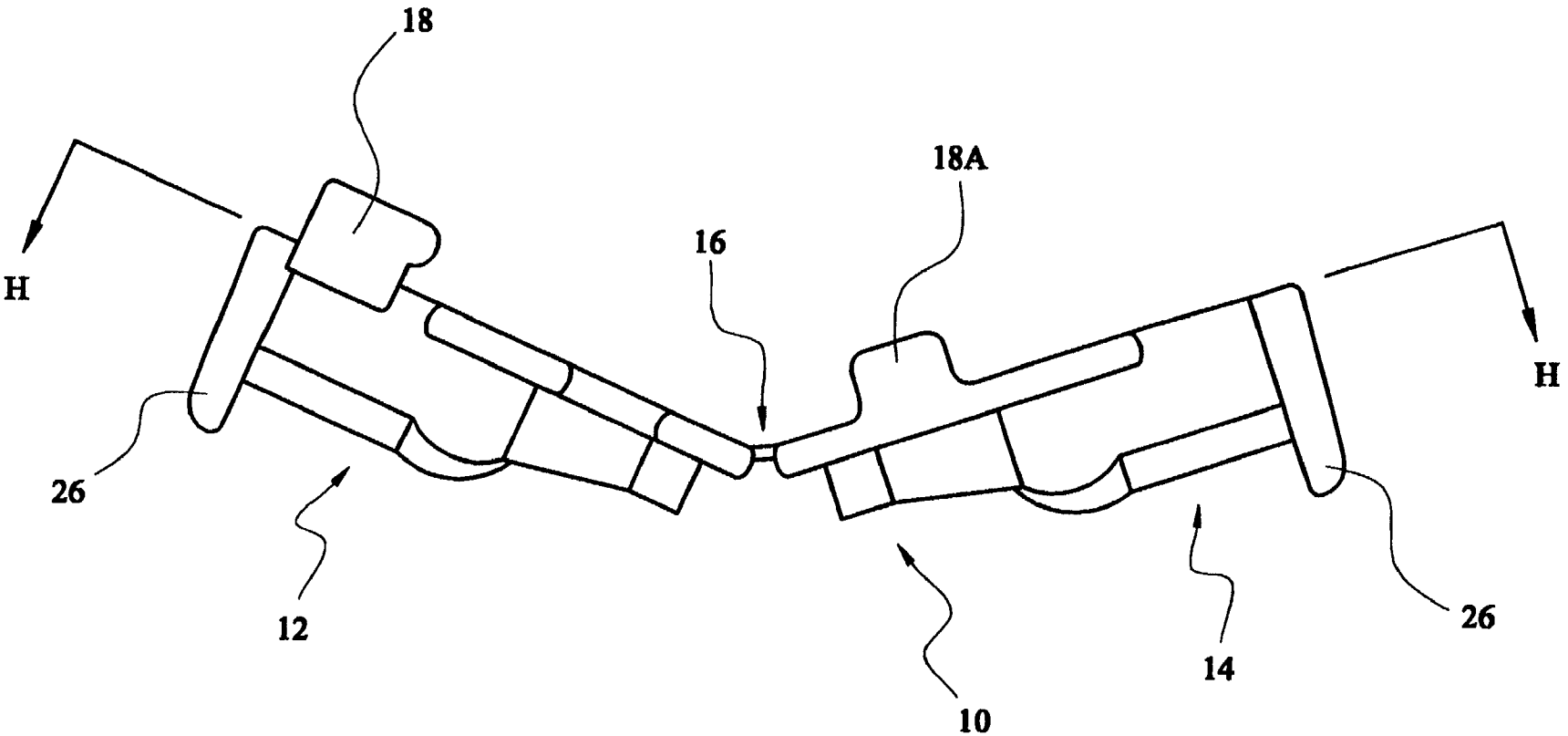
FIG. 3 shows a side elevation of a mounting assembly for an acoustic detector in accordance with the present position-defining and energy-isolating mountings.
Figure 6:
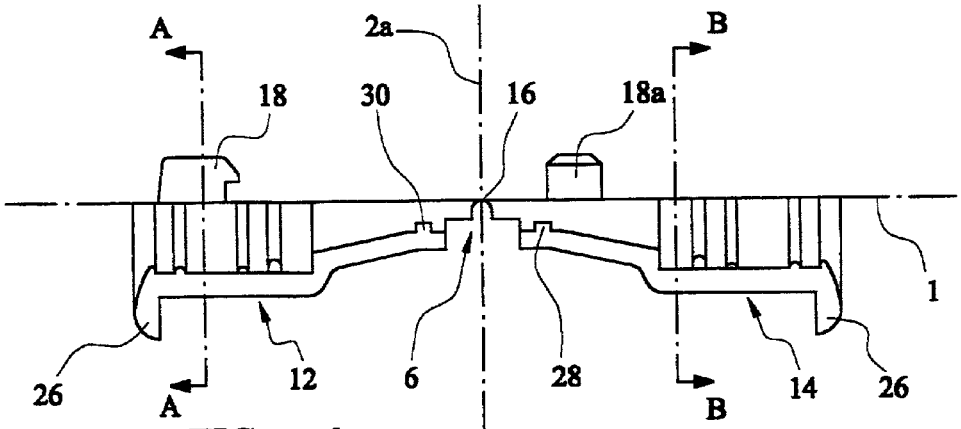
FIG. 6 is a longitudinal section through the assembly along, and as viewed, on section E—E of FIG. 4.
Figure 4:
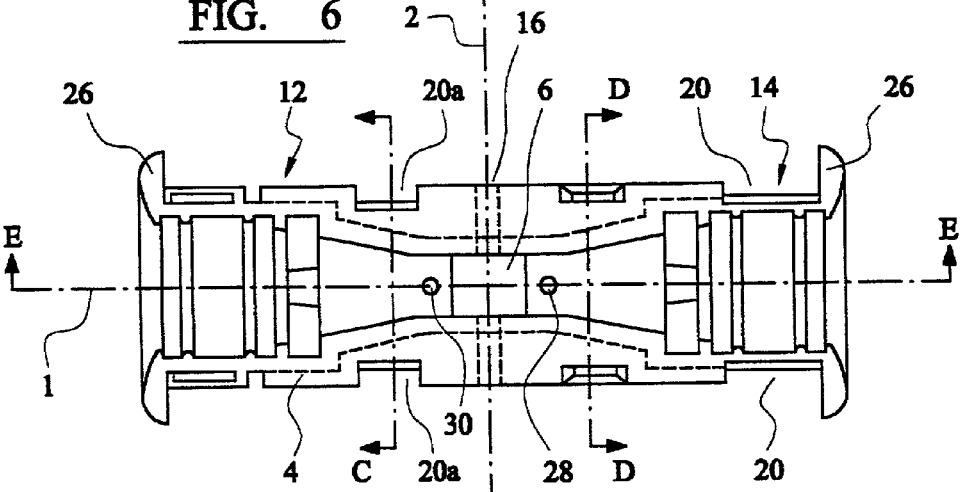
FIG. 4 is a plan view of the assembly of FIG. 3, as viewed on section H—H of FIG. 3.
Figure 5:
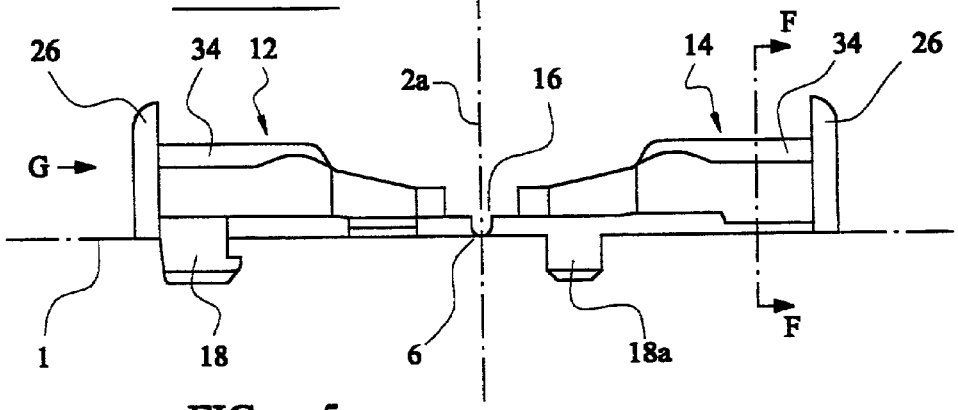
FIG. 5 is a more detailed side elevation of the assembly and is similar to FIG. 3.

As shown in FIG. 2, the receiver means 46 are mounted at a number of positions disposed along the length of the frame 44. Specifically a series of holes or apertures 32 are defined and provided within the frame 44 at predetermined positions. The receiving means 46 are mounted within these holes 32 via a suitable mounting arrangement 10.

The mounting 10 is shown in FIGS. 3 to 12. The mounting 10 comprises a molding in black polypropylene formed as two mounting halves 12, 14 connected by hinge means 16. The molding halves 12, 14 are split about a longitudinal plane through a central axis 1 of the assembled mounting. The central axis 1 of the mounting 10 when the mounting 10 is assembled and fitted into the frame 44, is coaxial with the axis of the aperture 32 within the frame 44. The hinge means 16 interconnects the two halves 12,14 at one end of the respective halves 12,14 and allows the two halves 12,14 to hinge about a lateral axis 2 perpendicular to, and passing through, the longitudinal axis 1 of the mounting 10. The general profile and shape of the two halves 12,14 is generally symmetrical about a plane 2*a* perpendicular to the central axis 1, and hinges axis 2 and passing through the hinge means 16.

The mounting halves 12,14 have a cooperating corresponding lateral cross section, as shown in FIG. 7 to 12. When the mounting 10 is hinged about the hinge means 16 (as shown by arrow X in FIG. 3) to bring the two halves 12,14 together with the longitudinal faces of the two halves 12,14 abutting each other. In this assembled position the two halves 12,14 of the assembled mounting 10 are disposed facing each other about the central axis 1. In the assembled mounting 10 the hinge means 16 are disposed at one end rather than, as shown in the figures being located in the middle of the mounting assembly 10.

The hinge means 16 simply comprise a region and web of thin material between and interconnecting the two halves 12,14. The web and mounting 10 are arranged such that the mounting 10 can be folded along the web, and the web bent, to allow the two halves 12,14 to be pivoted together over and on top of each other.

Projecting snap-fit formations 18 and 18A are provided on the mounting halves 12,14 to be received in corresponding snap-fit receptors 20, 20A provided in respective facing mounting half 14,12. When snap-fitted together a microphone (not shown) is gripped at its head on its opposite sides by opposed internal portions and surfaces 22, 24 of the mounting halves 10, 12, while the head of the microphone is shielded by the upstanding head structure 26 of the mounting halves. The microphone is of a generally circular cross section and accordingly the internal surfaces and profile of the mounting halves 12,14 have a semi circular cross section, corresponding to that of the microphone. When the mounting halves 12,14 are closed the internal surfaces 22,24 together define a circular profile and tapering recess within which to receive the microphone.

The snap-fit formations 18 and 18A and corresponding snap-fit receptors 20, 20A provide an easy, convenient and simple means to hold the two halves 12,14 of the mounting 10 together around the microphone and to thereby secure the microphone within the mounting 10.

The mounting 10 comprising the two mounting halves 12,14 and hinge means 16 comprises a single interconnected unitary plastic structure. As such the mounting 10 is a relatively simple structure and can be economically produced by suitable molding techniques known in the art. This can be contrasted with many prior energy isolating mountings which often comprise multiple elements of different materials which have to be attached to each other in order to form the mounting.

In use, the microphone and its associated cable or conductor is placed with its head on the gripping portion of the internal portions 22 or 24 of one of the mounting halves 12 or 14. The other half 14 or 12 is then brought towards it, and the two halves 12,14 are snap-fitted together, thereby gripping the head of the microphone and holding it firmly in a protected relationship thereto. The microphone cable passes lengthwise of the mounting halves 12,14 and through an opening 6 in the region of hinge means 16. When the mounting halves 12,14 are closed, the halves 12,14 thereby form a bushing for the microphone.

The microphone cable (not shown) is gripped between internally projecting portions 28 and 30 extending from the internal surfaces 22,24 of the mounting halves 12,14, thereby causing these to provide a strong mechanical link between the cable and the mounting whereby tension applied to the cable is directly transferred to the mounting and diverted from the cable connections of the microphone.

Figure 7:
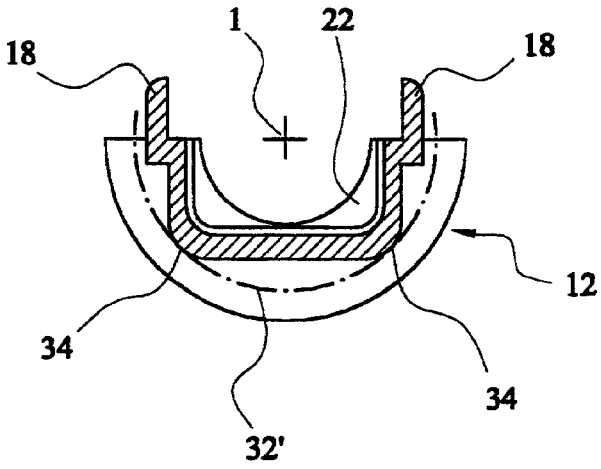
FIG. 7 is a cross sectional view of the assembly on section A—A of FIG. 6.
Figure 8:
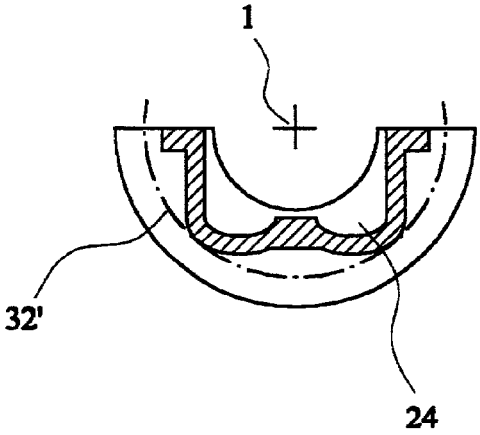
FIG. 8 is a similar cross sectional view of the assembly on section B—B of FIG. 6.
Figure 9:
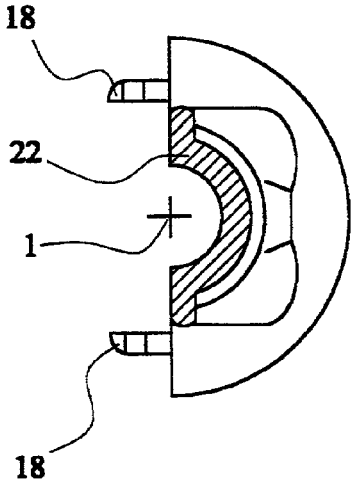
FIG. 9 is a cross sectional view of the assembly on section C—C of FIG. 4.
Figure 10:
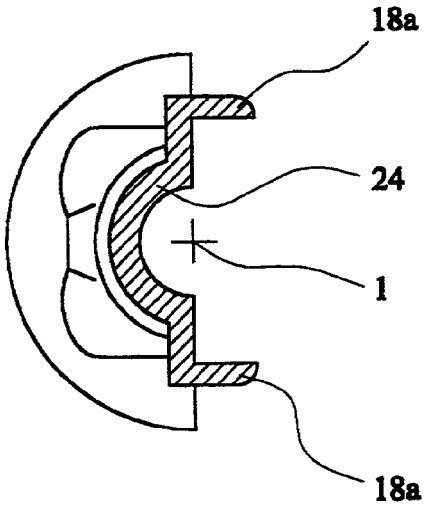
FIG. 10 is a similar cross sectional view of the assembly on section D—D of FIG. 4.
Figure 11:
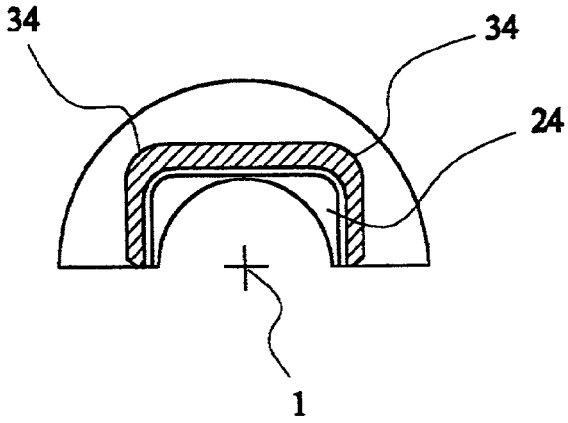
FIG. 11 is a sectional view of the assembly on section F—F of FIG. 5.
Figure 12:
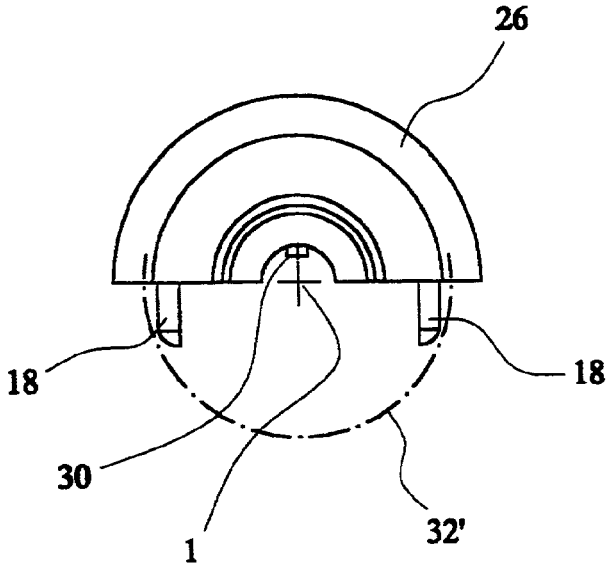
FIG. 12 is an end view of the assembly on arrow G of FIG. 5.

As shown in FIG. 7 the mounting 10, which when fitted to the microphone forms in effect a collet, is adapted to be a press fit into a mounting opening 32 in the support frame 44. The position of the mounting aperture 32 of the frame 44 is shown in FIGS. 7, 12, and 8 in relation to the mounting halves 12,14 by phantom circle line 32'. The mounting 10 which acts like a bushing provides contact at a plurality of spaced locations 34 (in this case four locations by virtue of the square cross section of the mounting halves 12,14). The bushing or mounting assembly 10 can thereby accommodate a degree of non-circularity of the opening 34 without prejudicing the accuracy of mounting.

A visible orientation mark (not shown) may also be provided on the mounting 10 to allow the mounting 10, and so microphone, to be correctly orientated about the central axis 1 when installed within the aperture 32 in the frame 44. Furthermore the mounting 10 may include a projection (not shown), extending outwards from the outside of the mounting 10 which engages a cooperatively shaped recess within the frame 44, and in particular within the aperture 32, so that the mounting 10 can only be fitted in the specified orientation. The outer profile of the aperture 32 and of the mounting 10 could also be cooperatively profiled to similarly ensure that the mounting 10 can only be fitted in the correct orientation. Such orientation features may be required within such systems 40 which use microphones which have differing responses and performance in differing directions. This however will depend upon the particular system 40, the way it calculates the position from the signals 41 and microphones/receivers used.

With systems 40 as described above, the beam or frame 44 to which the microphones are mounted will be subjected to the acoustic transmission from the transmitter means 48. The beam or frame 44 is a structural member and as such can be expected to be acoustically-transmissive. In other words the beam or frame can be expected to respond to the acoustic transmissions 41 and to transmit energy to the microphones mounted thereon through the frame structure 44 itself. Consequently conventionally the microphones are mounted to the frame 44 via suitable vibration damping means generally comprising an elastomeric material. A mounting using a non-elastomeric polymeric plastics material would normally have been expected not to provide vibration damping due to the different properties of such non elastomeric materials, and in particular the lack of natural resilience in such materials as compared to elastomeric materials. Accordingly a mounting 10 as described above using such materials, without any elastomeric material, would not generally have been considered as suitable. It has however been found in testing that the mounting 10 described above functions satisfactorily within systems 40 of the type described, and that the microphone, in use, is suitably isolated from the frame 44. Indeed in the tests such a mounting 10 performed slightly better than similar conventional rubber mountings. It is therefore believed that the previous conventional assumption that the microphones within such systems should be vibration isolated from the frame 44 is incorrect. All that is required is that the microphones are acoustically isolated from the frame 44.

Accordingly in use, the polypropylene material of the mounting 10 can, and does, serve to provide the required level of acoustic insulation to the microphone such that it can function correctly within the system 40, whilst also enabling it to be push fitted into its mounting beam or frame 44 in a convenient and easy manner.

Other similar non-elastomeric polymeric materials can be used instead of polypropylene. Such materials include, for example, nylon derivatives, acetyl, ABS and other non elastomers. Acetyl is the favorable material since this is less brittle at low temperatures (0° C.) and is therefore more robust than polypropylene. Furthermore a hinge means 16 made from acetyl will last longer than one made from polypropylene. Nylon derivatives are less favored due to their hygroscopic characteristics.

What is claimed is:

1. A method of mounting an acoustic transducer with respect to an acoustically transmissive structural mounting member characterized by providing a location-defining and acoustically isolating structure as a single unitary structure formed of non-elastomeric polymeric plastics material and having hingedly interconnected opposed portions of bushing means adapted to snap-fit together on opposite sides of the acoustic transducer, placing the transducer between the opposed portions, hingedly closing the opposed portions along opposite sides of the transducer, and snap-fitting the opposed portions together about the transducer in a location-defining and acoustically isolating manner.

2. The method as claimed in claim 1 in which the acoustic transducer, and the acoustically transmissive structural mounting member form part of a system for three-dimensional coordinate determination, and the method provides a means for mounting an acoustic emitter or detector within the system.

3. The method as claimed in claim 2 in which the non-elastomeric materials is polypropylene.

4. The method as claimed in claim 2 in which the non-elastomeric material is a nylon derivative.

5. The method as claimed in claim 2 in which the non-elastomeric material is acetyl.

6. Apparatus for mounting an acoustic transducer with respect to an acoustically transmissive structural mounting member characterized by location-defining and energy isolating structure as a single unitary structure formed of a non-elastomeric polymeric plastics material and including opposed portions of bushing means, hinge structure interconnecting the opposed portions for movement between open and closed conditions, the transducer on the opposed portions operable in the closed condition for engaging the transducer in a location-defining and energy-isolating manner, and snap structure on each of the opposed portions cooperating to snap-fit the opposed portions together in the closed condition.

7. Apparatus as claimed in claim 6 in which the non-elastomeric plastic is polypropylene.

8. Apparatus as claimed in claim 6 in which the non-elastomeric plastic is a nylon derivative.

9. Apparatus as claimed in claim 6 in which the non-elastomeric plastic is acetyl.

10. Apparatus as claimed in claim 9 in which the acoustic transducer, and the acoustically transmissive structural mounting member form part of a system for three-dimensional coordinate determination, and the apparatus provides a means for mounting the transducer within the system.

* * * * *